US011365513B2

(12) United States Patent
Fabry et al.

(10) Patent No.: US 11,365,513 B2
(45) Date of Patent: Jun. 21, 2022

(54) DUAL-SHEATH STRUCTURAL CABLE

(71) Applicant: SOLETANCHE FREYSSINET, Rueil Malmaison (FR)

(72) Inventors: Nicolas Fabry, Antony (FR); Paul Achkar, Saint-Cloud (FR); Matthieu Guesdon, Puteaux (FR)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 637 days.

(21) Appl. No.: 16/320,262

(22) PCT Filed: Nov. 18, 2016

(86) PCT No.: PCT/IB2016/001978
§ 371 (c)(1),
(2) Date: Jan. 24, 2019

(87) PCT Pub. No.: WO2018/020289
PCT Pub. Date: Feb. 1, 2018

(65) Prior Publication Data

US 2019/0242058 A1 Aug. 8, 2019

(30) Foreign Application Priority Data

Jul. 27, 2016 (WO) ..... PCT/2016/001314

(51) Int. Cl.
*D07B 1/16* (2006.01)
*D07B 1/14* (2006.01)
(Continued)

(52) U.S. Cl.
CPC ..... *D07B 1/162* (2013.01); *D07B 1/148* (2013.01); *E01D 19/16* (2013.01);
(Continued)

(58) Field of Classification Search
CPC .. D07B 1/14; D07B 1/148; D07B 2201/1092; D07B 2201/2094; D07B 2201/2095;
(Continued)

(56) References Cited

U.S. PATENT DOCUMENTS 4,612,680 A 9/1986 Daiguji
5,461,743 A 10/1995 Stubler et al.
(Continued)

FOREIGN PATENT DOCUMENTS

CN 2012269444 Y 7/2009
CN 202281125 U 6/2012
(Continued)

OTHER PUBLICATIONS

Espacenet translation of CN 204199176U, accessed on Jul. 21, 2021. (Year: 2015).*
(Continued)

*Primary Examiner* — Jeremy R Pierce
*Assistant Examiner* — Christine X Nisula
(74) *Attorney, Agent, or Firm* — Dentons US LLP

(57) ABSTRACT

A structural cable of a construction work. The structural cable including a bundle of load-bearing tendons, a first sheath containing the bundle of tendons, a second sheath arranged around the first sheath, the second sheath comprising windows, and a plurality of light-radiating modules configured to radiate light, each light-radiating module being arranged within the structural cable to radiate light through at least one window outwardly relative to the structural cable.

12 Claims, 3 Drawing Sheets

(51) Int. Cl.
*E01D 19/16* (2006.01)
*E01D 11/04* (2006.01)
*E04H 12/20* (2006.01)

(52) U.S. Cl.
CPC ..... *D07B 2201/1092* (2013.01); *D07B 2201/2044* (2013.01); *D07B 2201/2086* (2013.01); *D07B 2201/2087* (2013.01); *D07B 2201/2088* (2013.01); *D07B 2201/2091* (2013.01); *D07B 2201/2093* (2013.01); *D07B 2201/2094* (2013.01); *D07B 2205/201* (2013.01); *D07B 2401/202* (2013.01); *D07B 2501/203* (2013.01); *D07B 2501/2015* (2013.01); *E01D 11/04* (2013.01); *E04H 12/20* (2013.01)

(58) Field of Classification Search
CPC .... D07B 2201/2096; D07B 2201/2071; D07B 2201/2074; D07B 2201/2088; E04C 5/08; E04C 5/12; E04C 5/122; G02B 6/001; G02B 6/0005; G02B 6/0006
See application file for complete search history.

(56) References Cited

U.S. PATENT DOCUMENTS

| | | | |
|---|---|---|---|
| 5,479,671 | A | 1/1996 | Stubler et al. |
| 6,234,647 | B1 | 5/2001 | Liu |
| 7,631,384 | B2 | 12/2009 | Lecinq et al. |
| 7,779,499 | B2 | 8/2010 | Lecinq et al. |
| 2004/0037080 | A1 | 2/2004 | Luk et al. |
| 2006/0051035 | A1 | 3/2006 | Cavill |
| 2012/0058338 | A1 | 3/2012 | Fyfe et al. |
| 2012/0243225 | A1 | 9/2012 | Lee et al. |
| 2014/0079490 | A1 | 3/2014 | Han et al. |
| 2015/0113744 | A1 | 4/2015 | Stubler et al. |
| 2019/0249380 | A1 | 8/2019 | Brand et al. |

FOREIGN PATENT DOCUMENTS

| | | | |
|---|---|---|---|
| CN | 202403211 | U | 8/2012 |
| CN | 202416176 | U | 9/2012 |
| CN | 203086096 | U | 7/2013 |
| CN | 204199176 | U | 3/2015 |
| DE | 2425866 | A1 | 12/1975 |
| DE | 3403611 | A1 | 8/1985 |
| DE | 3529001 | | 2/1987 |
| DE | 19906374 | A1 | 9/2000 |
| FR | 2660332 | A1 | 10/1991 |
| GB | 2044726 | A | 10/1980 |
| JP | S54-26386 | Y2 | 8/1979 |
| JP | S55-126315 | U | 9/1980 |
| JP | S59-044559 | A | 3/1984 |
| JP | 30154405 | U | 10/1985 |
| JP | H01-92117 | A | 4/1989 |
| JP | H03-032309 | U | 3/1991 |
| JP | H04-37191 | B2 | 6/1992 |
| JP | H0620520 | A | 1/1994 |
| JP | 3066648 | U | 3/2000 |
| KR | 10-0901165 | B1 | 6/2009 |
| KR | 10-2013-0014092 | A | 2/2013 |
| WO | 88/09847 | A1 | 12/1988 |
| WO | 01/44680 | A1 | 6/2001 |
| WO | 2015/063511 | A1 | 5/2015 |

OTHER PUBLICATIONS

Pictures of Shangdi Bridge at http://bbs.zol.com.cn/dcbbs/d22_38792.html.

* cited by examiner

DUAL-SHEATH STRUCTURAL CABLE

CROSS-REFERENCE TO RELATED APPLICATIONS

This application is the National Stage Entry of International Application No. PCT/IB2016/001978, filed on Nov. 18, 2016, which claims the benefit of Application No. PCT/IB2016/001314, filed Jul. 27, 2016, all of which are hereby incorporated by reference in their entirety for all purposes as if fully set forth herein.

TECHNICAL FIELD

The present invention relates to structural cables used in the construction industry. It is applicable, in particular, to stay cables used for supporting, stiffening or stabilizing structures.

BACKGROUND

Stay cables are widely used to support suspended structures such as bridge decks or roofs. They can also be used to stabilize erected structures such as towers or masts.

A typical structure of a stay cable includes a bundle of tendons, for example wires or strands, housed in a collective plastic sheath. The sheath protects the metallic tendons of the bundle and provides a smooth appearance of the stay cable.

In certain cases, the sheath is in the form of an integral tube which extends from the lower anchoring point to the upper anchoring point of the stay cable. The tendons are threaded, usually one by one or small groups by small groups, into the sheath before anchoring them at both ends.

In other cases, the sheath is made of segments following each other along the cable. Each segment can be made of several sectors assembled around the bundle of tendons.

An object of the present invention is to propose another kind of sheath design for structural cables.

SUMMARY

To this end, the invention relates to a structural cable of a construction work, the structural cable comprising:

- a bundle of load-bearing tendons,
- a first sheath containing the bundle of tendons,
- a second sheath arranged around the first sheath, the second sheath comprising windows,
- a plurality of light-radiating modules configured to radiate light, each light-radiating module being arranged within the structural cable to radiate light through at least one window outwardly relative to the structural cable.

According to an aspect of the invention, at least one window is defined by an opening in the second sheath, the structural cable further comprising a reception element arranged through said opening or between the first and second sheath and in front of said opening, the reception element receiving at least one light-radiating module.

According to an aspect of the invention, the first and second sheaths define a circumferential gap therebetween, the structural cable further comprising at least one spacer element adapted to maintain the first and second sheaths apart, the spacer element being arranged in said gap and stretching over at least part of the circumference of said gap.

According to an aspect of the invention, the spacer element has a circumferential end secured to the reception element.

According to an aspect of the invention, the spacer element is secured to the second sheath.

According to an aspect of the invention, the spacer element is in contact with the first sheath.

According to an aspect of the invention, the reception element comprises a U-shaped profile defining an inner cavity for receiving a light-radiating module.

According to an aspect of the invention, the structural cable comprises a plurality of windows arranged in one or more groups each located at a respective region along the second sheath, the windows of a given groups being spread around the circumference of the second sheath.

According to an aspect of the invention, each window of at least one group is defined by an opening, the structural cable comprising a plurality of reception elements arranged through a respective opening or between the first and second sheath and in front of said respective opening, the reception elements each receiving at least one light-radiating module, the structural cable further comprising a plurality of spacer elements arranged between the first and second sheaths, each spacer elements being secured at its circumferential ends to one of said reception elements.

According to an aspect of the invention, the second sheath comprises a plurality of longitudinal portions assembled together, at least one longitudinal portion having at least one window defined by an opening which stretches over the entire length of said longitudinal portion.

According to an aspect of the invention, said longitudinal portion comprises a reception element arranged in said opening or between the second sheath and the first sheath and in front of said opening, a circumferential end of said longitudinal portion being secured to said reception element.

BRIEF DESCRIPTION OF THE DRAWINGS

Other features and advantages of the structural cable disclosed herein will become apparent from the following description of non-limiting embodiments, with reference to the appended drawings, in which.

DETAILED DESCRIPTION

Figure 1:
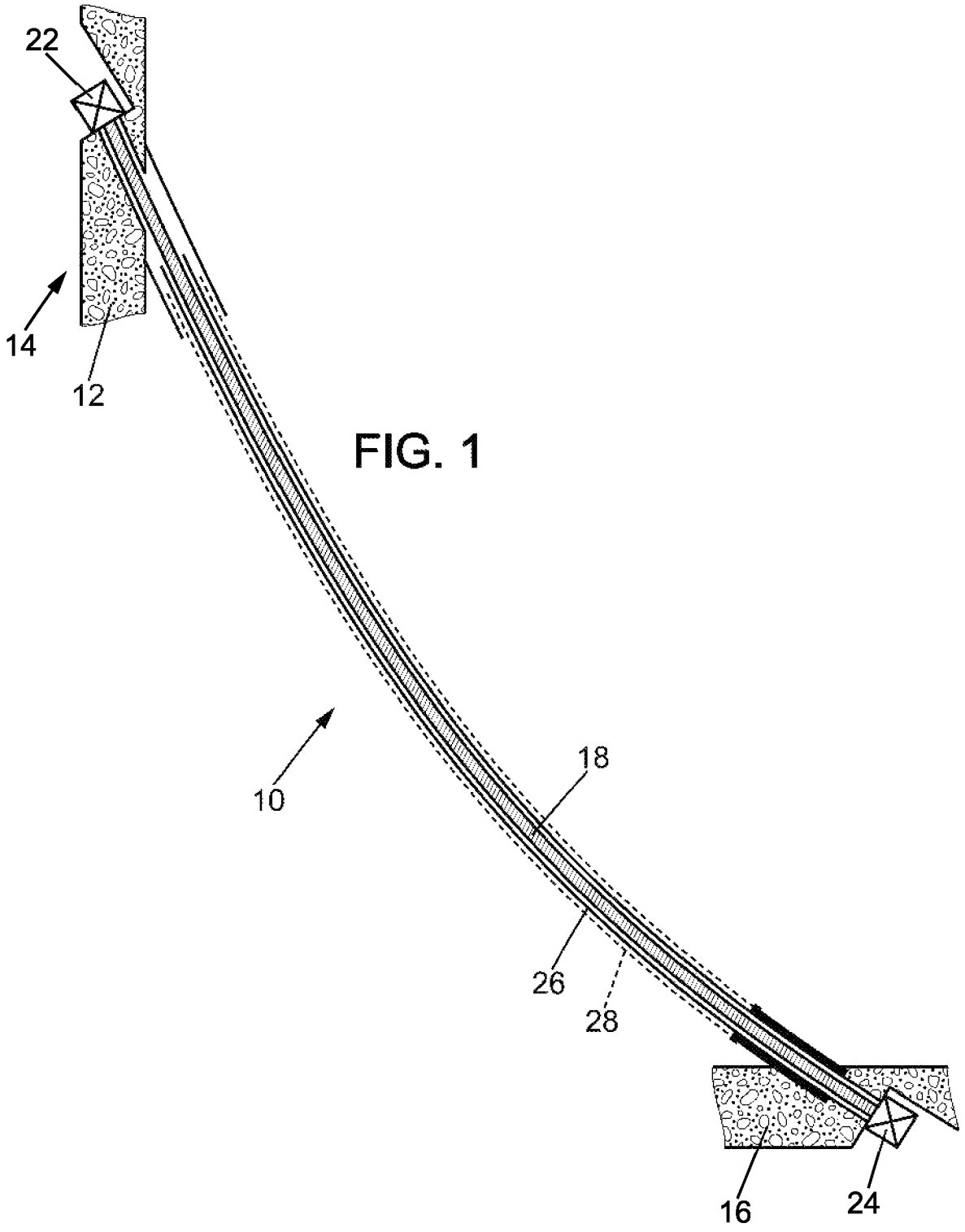
FIGS. 1 and 2 are illustrations of a structural cable according to the invention.

FIG. 1 shows a structural cable 10 according to the invention, hereinafter cable 10. The cable is preferentially a stay cable.

The cable is configured to take up efforts applied to a structure 12 to which it is anchored. To that end, it extends between two parts 14, 16 of a construction work. The first part 14 is for instance at a higher position than the second part 16. For example, the first part 14 belongs to the structure 12, such as a tower, while the second part 16 belongs to a foundation to stabilize the structure. Alternatively, the first part 14 may belong to a pylon, while the second part 16 belongs to some structure suspended from the pylon.

The construction work typically includes a number of structural cables 10, only one of them being shown in FIG. 1.

Figure 2:
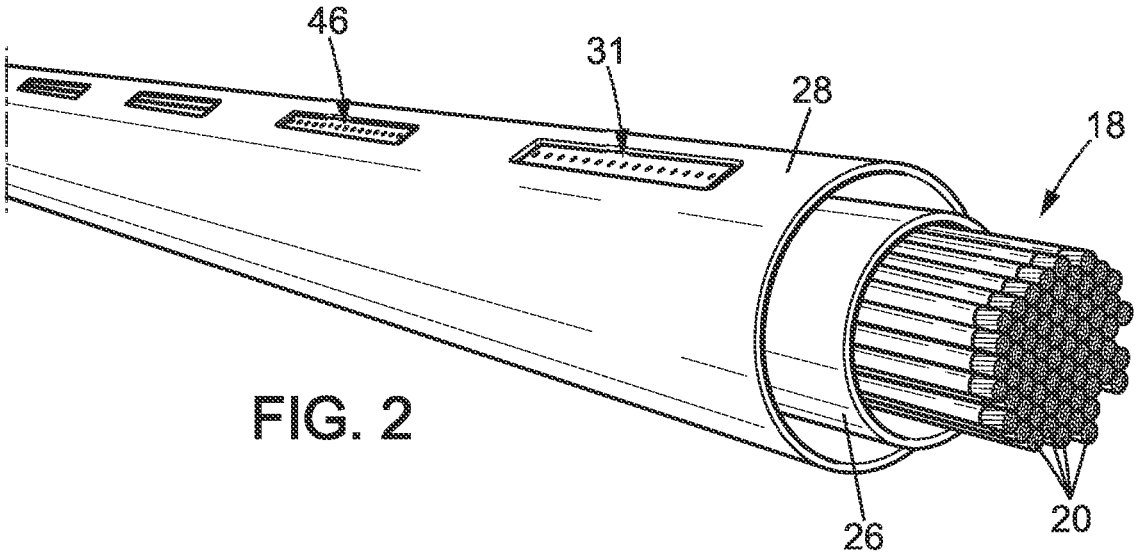

The structural cable 10 has a load-bearing part 18 which comprises a bundle of tendons 20 disposed parallel to each other (FIG. 2). For example, the bundled tendons may be strands of the same type as used to pre-stress concrete structures. They are for instance made of steel. Each strand may optionally be protected by a substance such as grease or wax and/or individually contained in a respective plastic sheath (FIG. 2).

The cable 10 may have a length of up to several hundred meters. It may include a few tens of tendons.

The load-bearing tendons are anchored at both ends of the bundle using an upper anchoring device 22 mounted on the first part 14 of the construction work and a lower anchoring device 24 mounted on the second part 16 of the construction work. Between the two anchoring devices 22, 24, the bundle of tendons for instance follows a catenary curve due to the weight of the cable and the tensile force maintained by the anchoring devices. The anchoring devices 22, 24 are positioned on the first and second parts 14, 16 by taking into account the pre-calculated catenary curve of each cable 10.

In reference to FIG. 2, the cable 10 presents a dual sheath configuration. In other words, the cable 10 includes a first sheath 26 and a second sheath 28.

The first sheath 26 contains the tendons 20. The second sheath 28 is arranged around the first sheath. The first sheath 26 thus forms an inner sheath, and the second sheath 28 an outer sheath.

In the example illustrated in FIG. 1, the first end of the first sheath 26 bears on a guide tube through which the bundle of tendons passes near the lower anchoring device 24, while the second end of the first sheath 26 penetrates into another tube disposed on the first part 14 of the construction work, through which the upper end of the bundle of tendons passes to reach the upper anchoring device 22. The second end of the first sheath 26 is for instance not connected to this tube, so that it can slide therein when the tendons 20 and the sheath 26 undergo different expansion or contraction on account of the thermal expansion coefficients of their materials. The arrangement prevents run off water from flowing inside the first sheath 26. The second sheath may have a similar configuration Advantageously, the second sheath 28 extends over more than 80% of the length of the bundle of tendons 20 between the anchoring devices 22, 24, or even more than 90% for long stay cables.

Advantageously, so does that the first sheath 26.

It should be noted that both sheaths may not have a same length.

Advantageously, the sheath 28 is present over at least the region of the cable located between the two tubes mentioned above.

Advantageously, the sheaths 26, 28 are concentrically arranged relative to one another. The two sheaths are for instance both centered (in terms of cross-section) on the direction along which the tendons stretch (which may be curved).

Advantageously, the second sheath 28 is arranged apart from the first sheath 26, whereby a gap 30 (FIG. 4*a*) is defined between them. This gap stretches around the first sheath, i.e. is circumferential. Advantageously, this gap has a radial dimension greater than the thickness of the second sheath.

The sheaths 26, 28 may have cross-sections which have different respective shapes, such as shapes chosen among polygonal, elliptical or circular shapes. For instance, both have circular-cross sections, as shown in the Figures. It should be noted that the shapes of the cross-sections of the sheaths may vary along the longitudinal direction of the sheaths. However, preferably, they do not.

The sheaths 26, 28 may be made of the same material. Alternatively, they may be made of different materials.

For instance, the first sheath 26 is made of high density polyethylene (known as PEHD or HDPE).

For instance, the second sheath 28 is made of polyethylene, such as PEHD. Advantageously, at least part of its outer surface has a color adapted to reflect light. For instance, it is thus white. Additionally or alternatively, at least the outer surface of the second sheath is resistant to ultraviolet rays. This may be the result of a surface treatment and/or of a specific composition of the material of the sheath itself over at least part of its thickness.

The outer surface of the second sheath 28 is destined to be in contact with the surrounding environment. It may present a surface treatment and/or structure destined to increase its resistance to the combined effects of rain and wind. For instance, the external surface of the second sheath 28 thus presents at least one helical rib, and advantageously a double helical rib, running helically along all or part of the length of the external surface of the second sheath 28 (not shown).

In some embodiments, over at least a portion of the length of the first sheath 26, at least the outer surface of the first sheath has a color adapted to reflect light. For instance, it is thus white. Additionally or alternatively, at least the outer surface of the first sheath over this portion is resistant to ultraviolet rays. This may be the result of a surface treatment and/or of a specific composition of the material of the sheath itself over at least part of its thickness.

This allows the first sheath to act as a protective outer shell against UVs and light in general should the second sheath need to be removed over the corresponding portion.

The respective thicknesses of the sheaths 26, 28 are for instance comprised between 2 mm and 20 mm.

Their respective diameters are for instance comprised between 50 mm and 500 mm.

In reference to FIGS. 3, 4*a* and 4*b*, the second sheath 28 includes at least one window 31 for allowing at least one light-radiating module (of reference 46, detailed below) arranged within the cable to radiate light outwardly relative to the cable and through this window.

The window 31 may be formed by a transparent region of the second sheath, i.e. a region whose material allows at least part of the light radiated by the light radiating-module to pass through it. This region is for instance integral with the rest of the second sheath.

However, advantageously, in the context of the invention, this window is defined by an opening 32 arranged in the second sheath. This opening is a through-hole.

Here, by "defined by an opening", it is to be understood that an opening has been made in the sheath so as to form the window, which does not preclude that this opening be later filled, for instance with a transparent material. This transparent material may form part of the light-radiating module itself, or may include a dedicated cover of appropriate dimensions and which may be maintained in a fixed position in the opening.

The following description will be made in reference to the windows 31 being defined by openings practiced in the outer sheath 28.

Advantageously, the cable 10 includes a plurality of such openings 32, each opening defining a window.

For instance, each opening 32 stretches longitudinally. For instance, they all present a same shape, such as a rectangular shape whose long sides are disposed longitudinally. Alternatively, they may be arranged in a different manner, for instance helically around the sheath, although in a preferred embodiment, they stretch longitudinally, as depicted in the Figures.

Advantageously, at a given longitudinal position of the second sheath which presents an opening 32, the second sheath 28 presents at least one other opening which is spaced apart from the other one(s) circumferentially around the second sheath.

In other words, the openings 32 are advantageously arranged in groups of openings, each group being located a given point along the length of the sheath. The openings of a given group thereby share a common (longitudinal) region of the sheath 28.

For instance, within each group, the openings 32 are regularly spaced apart around the second sheath. For instance, they are 180° apart for a group having two openings 32 (FIG. 3), 120° for a group having three openings (FIGS. 4*a* and 4*b*), etc. They may begin and end at the same longitudinal positions along the cable, as in the Figures.

Advantageously, the openings 32 all have a same form and same dimensions.

For instance, each opening has a length comprised between 10 cm and 50 cm. Their width is for instance comprised between 1 cm and 10 cm.

Figure 4A:
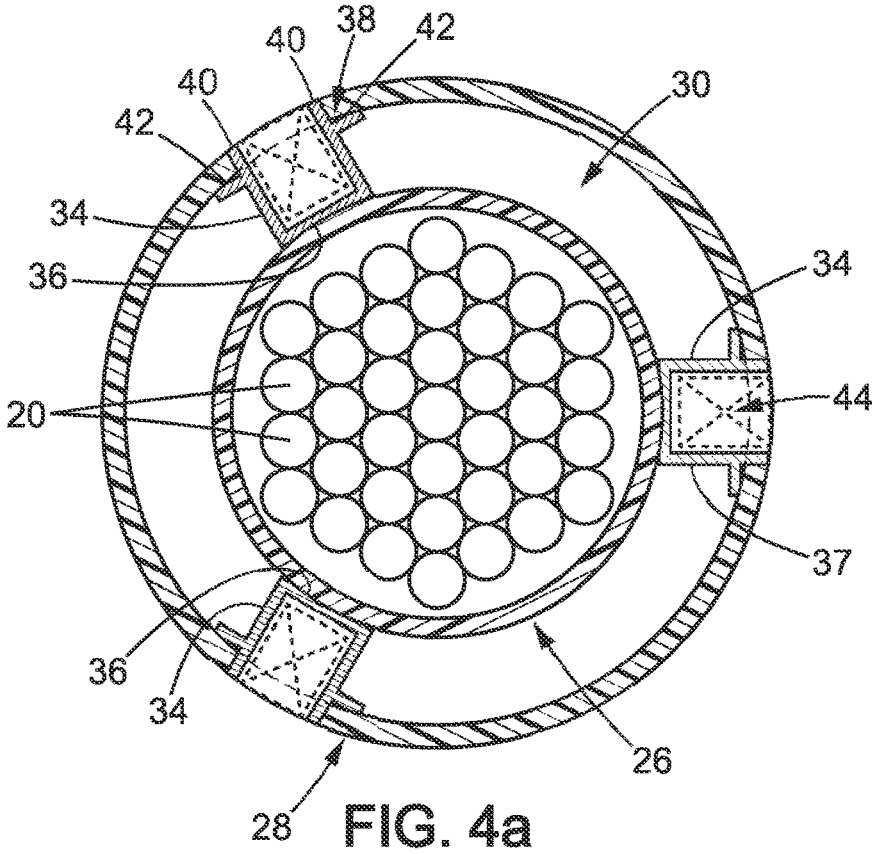
FIGS. 4*a* and 4*b* are cross-sections of a cable according to the invention.

The cable 10 further comprises a plurality of reception elements 34 (FIG. 4*a*). Advantageously, the cable 10 comprises at least one reception element 34 for each opening 32, and advantageously strictly one for each one.

Each reception element 34 is arranged in a given opening 32, for instance through the opening. Alternatively, it is received in the gap 30 and is facing the opening.

Advantageously, each reception element 34 is in fixed position relative to at least the second sheath. For instance, it is secured thereto, such as to the walls which internally delimit the opening 32, as detailed below.

Advantageously, the reception elements 34 include or consist of profiles, i.e. elements having a shape generated by a cross-section of given shape. They may also be known as hollow structural sections.

For instance, each profile presents the shape of a channel stretching longitudinally relative to the sheaths. This channel has a U-shaped cross-section. In others words, the profile presents a general U-shape configuration.

It exhibits a bottom portion 36 which is proximal relative to the first sheath 26, as well as lateral walls 37 which define the U-shape together with the bottom portion 36. The lateral walls may be parallel. Alternatively, they are slanted one relative to the other. For instance, they are arranged so that the distance that separates them decreases along the height of the profile, i.e. this distance being smaller near the opening.

In addition, each profile presents an upper portion 38. The upper portion 38 optionally presents upper lateral walls 40 which correspond to the upper ends of the lateral walls of the profile. In addition, it presents outward lips, or wings, 42 which stretch laterally and outwardly from the lateral walls of the profile.

Advantageously, the lips 42 are in abutment against the inner face of the second sheath 28. For instance, they are in direct contact with them, or are in contact with them through an intermediary connection element, such as a joint. Optionally, they are attached to the second sheath 28.

Moreover, the bottom portion 36 is advantageously in abutment against the first sheath 26. For instance, it is in direct contact, or through a connection element such as a joint. The profile 34 is advantageously maintained radially in position through its mechanical coupling with the two sheaths 26, 28. Optionally, the bottom portion 36 is secured to the inner sheath.

In some embodiments, the bottom portion may be at a distance from the first sheath 26 (and may or may not be secured to it).

Advantageously, the upper walls 40 are engaged in the opening 32. They are advantageously in abutment against the walls of the sheath 28 which define the opening 32. More specifically, their external face is advantageously in abutment against these walls, whereby the profile is maintained in position circumferentially through its cooperation with the walls of the corresponding opening 32. The walls 40 may be in direct contact with these walls, or in indirect contact, for instance through a connection element such as a joint. Optionally, they may be secured, i.e. attached, to the second sheath.

Preferentially, the upper walls 40 do not protrude from the opening outwardly relative to the cable. For instance, they are in a flush configuration relative to the outer surface of the sheath 28, i.e. they are at a substantially same level. Alternatively, their extremity is at a distance from the mouth of the opening.

Advantageously, the length of the profile corresponds to that of the opening 32 it is received in. In other words, the longitudinal ends of the profile 34 are advantageously in abutment against the walls of the sheath 28 which delimit the opening 32 longitudinally (for instance either directly or through a connection element). They may be secured to these walls.

Figure 3:
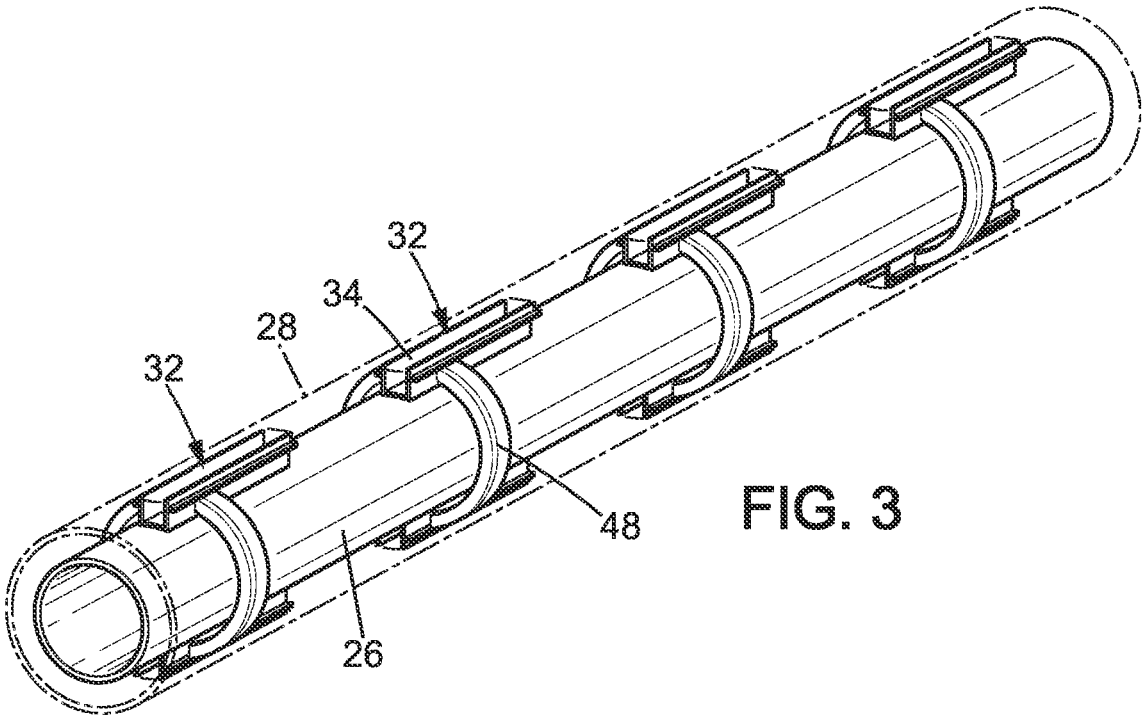
FIG. 3 is an illustration of a first and second sheaths of a cable according to the invention.

As shown on the Figures, the longitudinal ends of the profile are void of transverse walls (FIG. 3). Alternatively, they include transverse walls which cover all or part of the cross-section.

The profiles may be made of metal, such as aluminum. Alternatively, they may be made of plastic, such as HDPE or polyamide.

It should be noted that although the bottom portion 36, the lateral walls and the upper portion 38 have been described as forming part of the profiles, any reception element 34 may present all or part of these components, in particular a bottom portion, lateral walls, outward lips and upper wall extremities which are in the opening.

In a general manner, each reception element 34 defines an inner cavity 44 for receiving a component of the cable. In the context of the invention, these components advantageously include light-radiating modules 46 configured to radiate light outwardly at least through the corresponding window relative to the cable.

Each module 46 is configured to radiate light through one or more windows, and preferably through a single window. A reception element 34 may receive a single module 46, or a plurality of them depending of their dimensions.

For instance, each module comprises one or more light sources configured to emit light. These light sources may be electroluminescent, and may include light-emitting diodes. Other principles of light emission may be used alternatively or additionally, such as luminescence, for instance phosphorescence or fluorescence.

Alternatively, the modules may not include a light source themselves, but may receive light from a light source and radiate it outwardly relative to the cable, for instance after having reflected the light or after having guided it towards the window. This light source may be distant, and is either part of the cable or not.

However, preferably, the light-radiating modules include at least one light source, and are therefore light-emitting modules for generating and emitting light outwardly through an opening (or a window 31 in general).

Figure 4B:
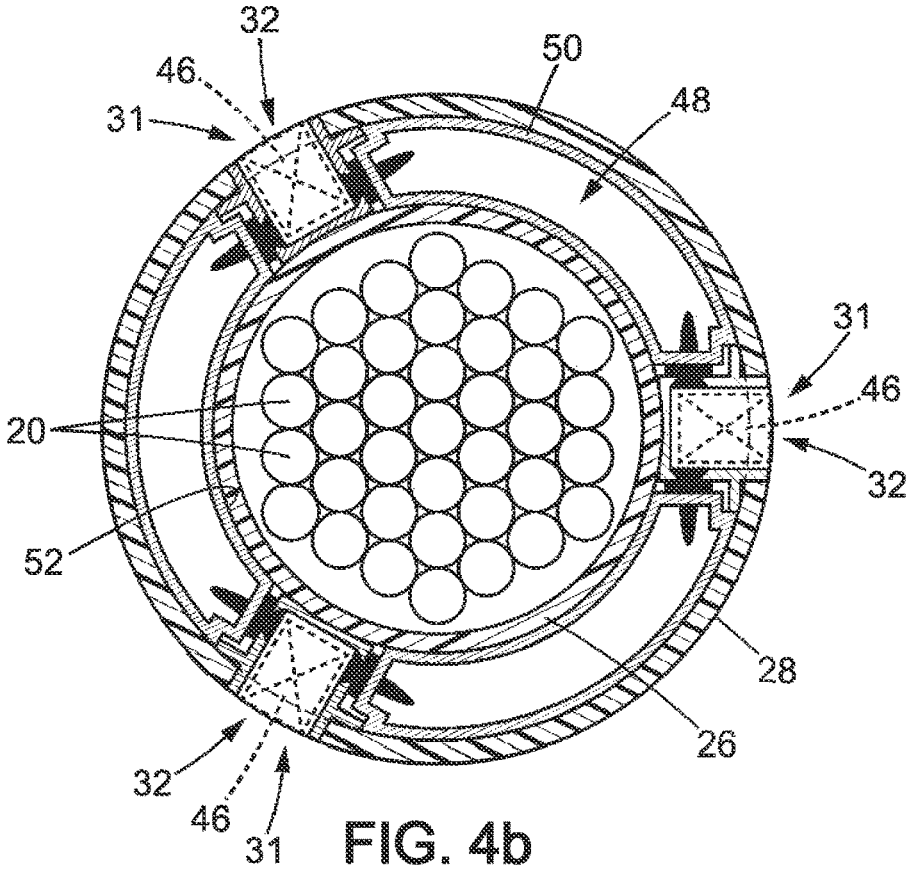

Still in reference to FIGS. 3, 4*a* and 4*b*, advantageously, the cable 10 further comprises at least one spacer element 48, and preferably a plurality of them.

Each spacer element 48 is arranged in the gap between the sheaths 26, 28, and is therefore between the sheaths.

Each spacer element 48 is adapted to maintain the sheaths 26, 28 apart from one another (at least locally).

In the context of the invention, this does not necessarily mean that the spacer element 48 is in contact with the sheaths 26, 28, or even with one of them.

However, the spacer element 48 is advantageously is contact at least with one sheath 26, 28, for instance the second sheath.

The precise configuration of the spacer element, in particular its shape, depends on the respective shapes of the cross-section of the sheaths 26, 28.

Advantageously, the spacer element 48 presents an external face 50 (FIG. 4*b*) having a cross-section complementary to that of the inner face of the outer sheath 28, and an inner face having a cross-section complementary to that of the outer face of the inner sheath 26.

In other words, each face of the spacer element 48 has a geometrical configuration matching that of the face of the sheath 26, 28 it is facing.

Each spacer element 48 stretches circumferentially within the gap 30.

Advantageously, at least some of the spacer elements 48 are arranged so as to stretch longitudinally at least over a region of the sheath 28 having a group of openings, as shown on FIGS. 3 and 4*a* and 4*b*. Within this region, each spacer element 48 stretches circumferentially within the gap 30. Advantageously, it stretches circumferentially between two adjacent reception elements 34.

The circumferential ends of the spacer element 48 are advantageously secured to the corresponding reception element 34. For instance, they are secured using any known means, such as a screw-bolt type of device, or through riveting. They are for instance secured to the outer faces of the lateral walls of the reception elements.

In addition, the longitudinal dimension of each spacer element (relative to the sheath and the tendons) is advantageously inferior to that of an opening 32. For instance, it is inferior to 20 cm, and for instance to 10 cm.

In the example of the FIGS. 3, 4*a* and 4*b*, each spacer element 48 presents a configuration of a circumferential segment of a ring and extends from one reception element 34 to the next reception element of the same group (i.e. to reception elements attached to openings of a same group).

In some embodiments, all or part of the spacer elements 48 may extend solely over part of the gap between two adjacent reception elements, each such gap having for instance a plurality of spacer elements which are consecutively and circumferentially arranged between the two consecutive reception elements 34. At least one end of a spacer element may then be secured to a circumferential end of the adjacent spacer element.

For a given group of openings, the cable 10 may include a plurality of spacer elements 48 along the length of the openings. In other words, the circumferential gaps between two reception elements of a same group may each include a plurality of spacer elements which are spread apart longitudinally. For instance, in reference to FIG. 3, for each group, the cable may include a two or more rings defined by spacer elements 48.

In an embodiment (not shown), at least one spacer element 48 is located in a region of the cable which bears no window 31, for instance a region located between two groups of windows.

The spacer element 48 advantageously stretches circumferentially around the entirety of the gap 30. In other words, it surrounds the inner sheath entirely, and may present an annular shape surrounding the inner sheath.

In some embodiments, at least one spacer element may present a form different from that of a ring or segment of a ring. More specifically, the spacer element 48 may have a longitudinal dimension greater than that of an opening. For instance, it is equal or greater than the distance separating two groups of openings in the longitudinal direction.

Each corresponding spacer element may then be secured at one circumferential end (i.e. at its long side) to a plurality of profiles 34 received in openings which are distant longitudinally from one another, i.e. two profiles of different respective groups which occupy a same position within their group. This may be so for both its circumferential ends.

The spacer elements 48 are preferably in fixed respective positions.

Several embodiments are envisaged regarding their being maintained in fixed position.

As indicated above, all or part of them may be secured to at least one reception element by one of their circumferential ends. This may be done through a screwing mechanism, riveting, through a form of bonding or other. All or part of them may be so secured by both circumferential ends, but some may solely be secured to a reception element by one of their ends.

Alternatively or additionally, they may be secured (i.e. fixed) to at least one sheath, and possibly to both of them. This may be carried out using any known means, e.g. through gluing, bonding such as welding, etc.

Alternatively, they may not be attached either to the sheaths or to the reception elements. Advantageously, they are then in abutment against the first sheath and/or the second sheath. For instance, they are calibrated to have a shape at a given temperature which results in their being pressed against one of the sheath.

For instance, in that case, the temperature at which they are installed is made different (through heating or cooling) from that which is expected after the cable has been installed, whereby the spacer elements 48 dilate or retract after having been installed so as to press against the chosen sheath.

In some embodiments, they are compressed between the two sheaths, and are thereby maintained in position.

It should be noted that in that case, the corresponding spacers may be located anywhere along the length of the cable, and not necessarily at a longitudinal region which bears windows 31. In addition, they may have a circumference which is either greater or smaller that the circumferential distance between two openings or windows of a given group. As indicated above, and regardless of their length (which may be chosen freely), they may for instance extend over the entire circumference of the gap 30. Some may also extend over a much smaller angular area.

It should be noted that in FIG. 4*b*, the spacer elements 48 have been depicted as hollow. However, this is so for clarity reasons, the spacer elements 48 being either hollow or not. Advantageously, the spacer elements 48 are full. Alternatively, the spacer elements 48 are partly hollow and partly full (for instance in different portions).

Advantageously, at least some of the spacer elements 48, in particular some of those which are full, include at least one through-hole to allow the passage of connecting elements therethrough which run along the cable (not shown).

For instance, the spacer elements 48 are made of plastic, such as polyethylene (such as PEHD) or polyamide. Alternatively, they may be made of metal.

In a general manner, different embodiments may be envisaged in terms of contact and attachment between the components of the cable, in particular, the sheaths, the reception elements and the spacer elements.

In a first configuration, the different elements are in contact with one another. More specifically, the reception elements are in contact with the inner sheath 26 and the second sheath, and so are the spacer elements 48. In addition, the latter are also in contact with the reception elements. In this first configuration, the relative positions of the first and second sheaths 26, 28 are maintained through the cooperation of these elements together.

In a second configuration, there are clearances between the inner sheath 26 and the rest of these elements, which are for instance in contact with one another as in the first configuration. More specifically, for a given group of openings 32 (or windows in general), the inner sheath 26 is not in contact with at least one spacer element 48 associated with this group and/or is not in contact with the bottom portion of a given profile.

In effect, due to its weight, the inner sheath tends to rest on the elements located beneath it. In case clearances have been introduced, this translates into the inner sheath standing apart from the profiles and/or the spacer elements located above it. Such a second configuration is advantageous for the insertion of the inner sheath in the outer sheath for the manufacture of the full cable duct.

In further configurations, the spacer elements may not be in contact with a sheath or a reception element. Advantageously, the reception elements are in contact with the second sheath.

In any of the configurations, the different components may or may not be secured to one another.

Preferably however, the reception elements are attached at least to one of the sheaths. Moreover, the spacer elements are preferably attached to at least one element among a sheath and a reception element.

The sheaths, and in particular the outer sheath, are advantageously obtained from a plurality of longitudinal sheath portions which are assembled together, for instance in a known manner such as mirror-welding. These portions may have a length greater than 10 meters, for instance of about 12 meters.

In a specific embodiment, for at least one of said longitudinal portions of the outer sheath, at least one opening 32 stretches over the entire length of the portion. For instance, all do.

In this embodiment, this portion may be defined by a plurality of circumferential sheath portions each covering an angle corresponding to the angle between two openings (around the direction of the bundle).

Preferably, each circumferential portion is secured by its circumferential ends to a reception element 34. For instance, a given circumferential end is fixed to the lips 42 of the corresponding profile. Advantageously, the corresponding profiles do not include upper lateral walls, i.e. portions of the lateral walls that extend beyond the lips into the corresponding opening. In this configuration, the reception elements are for instance arranged in the gap 30 and face the opening without be received in it.

It should be noted that the lips may be arranged so as to be tangential relative to the inner face of the second sheath. Alternatively, they are curved to match the shape of this inner face. This may be so for each or some of the portions, even for some whose openings only stretch over part of their length.

Advantageously, the fixation of the portion of the sheath onto the reception element is achieved through riveting.

An opening 32 is then defined between the circumferential ends of two adjacent circumferential sheath portions.

In case a single opening 32 runs along the entire length of the portion, the portion includes a single piece of sheath whose circumferential ends are both secured to the reception element (or elements) which is arranged in the opening (or through it, or facing it from the gap).

A manufacturing process of a cable according to the invention will now be described in reference to the Figures.

During a first step, a given longitudinal portion of the second sheath 28 is obtained. The windows, for instance through the definition of corresponding openings 32, are then arranged in the portion at the desired positions. Then, the reception elements 34 are arranged in the openings 32 (or in front of one inside the sheath), and are secured thereto (and optionally to the second sheath itself). Thereafter, the spacer elements 48 are installed in the second sheath, and are optionally secured to the reception elements 34 and/or the inner wall of the sheath 28 depending on the chosen configuration. Optionally, the modules 46 are then installed in the openings, and the elements connecting them to a source of electrical energy are installed as well. Alternatively, the modules 46 and their connection elements are installed at a later time.

For a given portion destined to have openings 32 which run along its entire length, the openings are preferably made after the spacer elements 48 and the reception elements have been inserted in the second sheath. Preferably, they are made after the reception elements are secured to the sheath (for instance through riveting the sheath to the lips 42), and (optionally although preferably) after the spacer elements 48 have been attached to the sheath (through any known process). In this configuration, the spacer elements 48 are thus optionally but preferably fixed to the reception elements 34 and the second sheath 28. In addition, the spacer elements 48 and the reception elements 34 are preferably attached to the inner sheath as well in a following step.

During a second step, a longitudinal portion of the first sheath which has a same length as that obtained in claim 1 is also obtained.

During a third step, the portion of the inner sheath is inserted in the portion of the outer sheath, thereby forming a portion of the dual sheath. Once inserted, the spacer elements and/or the reception elements are optionally attached, i.e. fixed, to the first sheath, depending on the chosen configuration.

These steps are repeated so as to obtain the number of desired portions of the dual sheath for the entire cable.

During a fourth step, these portions are assembled together. To that end, a longitudinal end of a given portion of the dual sheath is assembled to that of another one. To that end a welding process, such as a mirror welding process, is for instance employed, whereby the longitudinal ends of the two portions (in effect, the extremities of the sheaths) to be assembled are heated before being pressed against one another.

The result is the dual sheath having the total desired length.

During a fifth step, the tendons are installed in the dual sheath. To that end, the dual sheath is brought to a position close to its final position. If need be, one or a few tendons are previously inserted in it, for instance to support and help guide the positioning of the dual sheath.

Once in position, the tendons are successively inserted in the first sheath so as to form the bundle of tendons, each tendons being anchored at its ends with the appropriate tension. This is repeated until all the tendons are received in the first sheath and the bundle is appropriately anchored.

In an alternative manufacturing process, the first step does not include inserting the spacer elements and the reception elements in the second sheath. Instead, these components are attached to the inner sheath 26 during the second step. During the third step, the spacer elements 48 and/or the reception elements are optionally attached to the second sheath depending on the chosen configuration.

The invention presents several advantages.

In particular, it allows obtaining a cable capable of radiating light in an efficient manner which does not require the manufacture of sheaths which are rendered complex and costly to both manufacture and assemble.

In addition, it is adaptable in terms of functional cavities and spacing configurations.

In the description given above, the reception elements 34 have been described as being based on profiles. Alternatively, they may take any form, such as one of a container having any shape. The upper face of this container may be transparent for the light of the modules 46. Alternatively, the container may not include an upper face, whereby the inner cavity 44 is open radially.

In addition, as indicated above, beyond being defined by an opening in the sheath, they may include a cover which is transparent for the light of the module(s) which are to radiate light through them.

In some embodiments, the reception elements 34 may form part of the modules 46 themselves (for instance for at least some of them). For instance, a given reception element consists of a container of the module 46 within which the rest of the components of the module are arranged.

Other embodiments may be envisaged. In particular, in some embodiments, the embodiments above may be combined together when technically possible. For instance, the spacer elements, the reception elements and/or the windows may have a first configuration along a given portion of the cable, and another one along another portion of a cable. In addition, different types of reception elements, spacer elements and/or windows may be used at a given point along the cable. In some embodiments in which the windows are not defined by openings, any reception element such as those disclosed above may be used. Advantageously, they are then arranged in the gap 30 and in front of the corresponding window.

The invention also relates to a structural cable of a construction work, the structural cable comprising:

a bundle of load-bearing tendons, a first sheath containing the bundle of tendons, a second sheath arranged around the first sheath, the second sheath comprising at least one opening, a reception element arranged through said opening or between the first and second sheath and in front of said opening, the reception element defining an inner cavity for receiving a piece of equipment.

In view of the description above, this definition of the invention may be taken in conjunction with any of the features detailed above and which may be reflected in the following claims.

The invention claimed is:

1. A structural cable of a construction work, the structural cable comprising:

a bundle of load-bearing tendons;

a first sheath containing the bundle of tendons;

a second sheath arranged around the first sheath, the second sheath comprising windows; and a plurality of light-radiating modules configured to radiate light, wherein each light-radiating module is arranged within the structural cable to radiate light through at least one window defined by an opening in the second sheath, outwardly relative to the structural cable, the structural cable further comprising a reception element arranged through the opening or between the first and second sheaths and in front of the opening, wherein the reception element receives at least one light-radiating module.

2. The structural cable of claim 1, wherein the first and second sheaths define a circumferential gap therebetween, the structural cable further comprising at least one spacer element adapted to maintain the first and second sheaths apart, and wherein the spacer element is arranged in the gap and extends over at least part of the circumference of the gap.

3. The structural cable according to claim 2, wherein the spacer element has a circumferential end secured to the reception element.

4. The structural cable according to claim 2, wherein the spacer element is secured to the second sheath.

5. The structural cable according to claim 2, wherein the spacer element is in contact with the first sheath.

6. The structural cable according to claim 1, wherein the reception element comprises a U-shaped profile defining an inner cavity for receiving a light-radiating module.

7. The structural cable according to claim 1, wherein the windows of the second sheath are arranged in one or more groups each located at a respective region along the second sheath, and wherein the windows of each group are disposed around the circumference of the second sheath.

8. The structural cable of claim 2, wherein the windows of the second sheath are arranged in one or more groups each located at a respective region along the second sheath, wherein the windows of each group are disposed around the circumference of the second sheath, wherein each window of at least one group is defined by an opening, the structural cable comprising a plurality of reception elements arranged through a respective opening or between the first and second sheaths and in front of the respective opening, wherein each of the reception elements receives at least one light-radiating module, the structural cable further comprising a plurality of spacer elements arranged between the first and second sheaths, and wherein each spacer elements is secured at circumferential ends thereof to one of the reception elements.

9. The structural cable according to claim 1, wherein the second sheath comprises a plurality of longitudinal portions assembled together, at least one longitudinal portion having at least one window defined by an opening extending over the entire length of the longitudinal portion.

10. The structural cable of claim 9, wherein the longitudinal portion comprises a reception element arranged in the opening or between the second sheath and the first sheath and in front of the opening, a circumferential end of the longitudinal portion being secured to the reception element.

11. A structural cable of a construction work, the structural cable comprising:

a bundle of load-bearing tendons;

a first sheath containing the bundle of tendons;

a second sheath arranged around the first sheath, the second sheath comprising windows; and a plurality of light-radiating modules configured to radiate light, wherein each light-radiating module is arranged within the structural cable to radiate light through at least one window outwardly relative to the structural cable, wherein the second sheath comprises a plurality of longitudinal portions assembled together, and wherein at least one longitudinal portion has at least one window defined by an opening extending over the entire length of the longitudinal portion.

12. The structural cable of claim 11, wherein the longitudinal portion comprises a reception element arranged in the opening or between the second sheath and the first sheath and in front of the opening, wherein a circumferential end of the longitudinal portion is secured to the reception element.

* * * * *